US006129992A

United States Patent [19]

Sakuma et al.

[11] Patent Number: 6,129,992

[45] Date of Patent: Oct. 10, 2000

[54] HIGH-STRENGTH COLD ROLLED STEEL SHEET AND HIGH-STRENGTH PLATED STEEL SHEET POSSESSING IMPROVED GEOMAGNETIC SHIELDING PROPERTIES AND PROCESS FOR PRODUCING THE SAME

[75] Inventors: Yasuharu Sakuma; Satoru Tanaka; Kazuo Koyama; Yujiro Miyauchi, all of Kimitsu; Takeshi Kubota, Futtsu; Atsushi Itami, Kimitsu; Hiroaki Kato, Shinagawa-ku; Chohachi Sato, Shinagawa-ku; Teruo Takeuchi, Shinagawa-ku, all of Japan

[73] Assignees: Nippon Steel Corporation; Sony Corporation, both of Tokyo, Japan

[21] Appl. No.: 09/348,227

[22] Filed: Jul. 6, 1999

Related U.S. Application Data

[63] Continuation of application No. PCT/JP98/04933, Oct. 30, 1998.

[30] Foreign Application Priority Data

Nov. 5, 1997 [JP] Japan ..... 9-302631
Mar. 16, 1998 [JP] Japan ..... 10-065055

[51] Int. Cl.[7] ..... H01F 1/00

[52] U.S. Cl. ..... 428/611; 148/111; 148/112; 148/518; 148/307; 257/659; 313/402; 348/820; 428/659; 428/679; 428/681; 428/900; 428/928; 428/935

[58] Field of Search ..... 428/611, 681, 428/659, 679, 900, 928, 935; 148/111, 112, 518, 307; 257/659; 313/402; 348/820

[56] References Cited

U.S. PATENT DOCUMENTS 4,601,766 7/1986 Rastogi et al. ..... 148/111
5,019,191 5/1991 Ogata et al. ..... 148/307
5,871,851 2/1999 Fukumizu et al. ..... 428/679

FOREIGN PATENT DOCUMENTS 59-171431 9/1984 Japan .
62-185828 8/1987 Japan .
1-108315 4/1989 Japan .
2-170919 7/1990 Japan .
3-134140 6/1991 Japan .
4-341541 11/1992 Japan .

*Primary Examiner*—Deborah Jones
*Assistant Examiner*—Robert R. Koehler
*Attorney, Agent, or Firm*—Kenyon & Kenyon

[57] ABSTRACT

Provided are a high strength cold rolled steel sheet and a high strength plated steel sheet possessing improved geomagnetic shielding properties, that is, having a high relative permeability in a d.c. magnetic field around 0.3 Oe, a process for producing the same, and an explosion-proof band or an outer magnetic shielding material, for television cathode-ray tubes, using the steel sheet. An ultra low carbon steel, which has a carbon content of not more than 0.0060% and has been subjected to solid solution strengthening utilizing silicon and magnesium without relying upon precipitation strengthening, is deoxidized with silicon so that aluminum is substantially absent in the steel. Alternatively, when the ultra low carbon steel is deoxidized with aluminum, boron is added to inhibit the precipitation of AlN. Next, the deoxidized steel is finish rolled at 750 to 980° C., cold rolled with a reduction ratio of 60 to 90%, and then annealed in the temperature range of 750° C. to the $Ac_3$ point in a continuous annealing equipment or an in-line annealing type continuous galvanizing equipment to bring the ferrite grain diameter in the metallographic structure to 10 to 200 μm.

20 Claims, 1 Drawing Sheet

A=( 2 + 8 ) /2
B=( 1 + 3 + 7 + 9 ) /4
C= 5
D=( 4 + 6 ) /2

HIGH-STRENGTH COLD ROLLED STEEL SHEET AND HIGH-STRENGTH PLATED STEEL SHEET POSSESSING IMPROVED GEOMAGNETIC SHIELDING PROPERTIES AND PROCESS FOR PRODUCING THE SAME

This application is a continuation of International application PCT/JP98/04933 filed Oct. 30, 1998.

TECHNICAL FIELD

The present invention relates to a high strength cold rolled steel sheet and a high strength plated steel sheet (coated steel) possessing improved geomagnetic shielding properties, an explosion-proof band or an outer magnetic shielding material for television cathode-ray tubes using the steel sheet, and a process for producing the same.

BACKGROUND ART

Typical properties required of steel sheets for use in domestic electrical appliances, automobiles, furniture, building and the like include strength and resistance to rusting. Parts of television cathode-ray tubes, such as explosion-proof bands and support frames, should shield the influence of geomagnetism so that electron beams, when passed through a space constituted thereby, are not deflected. Improved geomagnetic shielding properties referred to herein mean that the relative permeability in a d.c. magnetic field around 0.3 Oe corresponding to geomagnetism is large. Use of steel sheets satisfying this property requirement even in automobiles, which have more and more become electronically controlled, creates a possibility of the prevention of erroneous actuation of instruments.

In general, improved geomagnetic shielding properties can easily be realized by using non-oriented magnetic steel sheets such as specified in JIS C 2552. In this case, what is required is only to increase the relative permeability in a d.c. magnetic field around 0.3 Oe corresponding to geomagnetism, and, unlike rotary machines, properties in high magnetic field are not required. If such steel sheets could be produced in the same equipment as used for the production of steel sheets for press working, the thickness range of producible sheets could be broadened and, in addition, the production cost could be reduced.

Reducing fine precipitates present in steel or coarsening ferrite grains to facilitate the movement of domain walls is known to be effective in increasing the relative permeability in a d.c. magnetic field around 0.3 Oe corresponding to geomagnetism. For example, Japanese Patent Laid-Open Publication No. 61330/1991 discloses a method wherein a low carbon aluminum killed steel is subjected to open coil decarburization annealing to coarsen grains. Further, Japanese Patent Publication No. 6134/1996 and Japanese Patent Laid-Open Publication No. 27520/1996 discloses a method wherein a steel having a carbon content reduced to not more than 0.01% with reduced impurities is continuously annealed to coarsen grains. For steel sheets produced by these methods, however, the yield point is estimated to be about 250 MPa at the highest.

On the other hand, when reducing the amount of steel products used is contemplated from the viewpoints of a reduction in weight and life cycle assessment (LCA), a high yield point of, for example, 250 to 300 MPa or more, is required. This necessitates enhancing the yield point through utilization of one of or a combination of two or more of solid solution strengthening, fine grain strengthening, precipitation strengthening, and work strengthening. In any case, however, geomagnetic shielding properties rapidly deteriorate with increasing the yield point. Further, when the silicon content is increased, plates are likely to be broken at the time of rolling, leading to lowered productivity and yield. This makes it impossible to attain the object.

Accordingly, it is an object of the present invention to solve the above problems of the prior art and to provide high strength cold rolled steel sheets and high strength plated steel sheets having improved geomagnetic shielding properties, that is, high relative permeability in a d.c. magnetic field around 0.3 Oe, and a process for producing the same. It is another object of the present invention to provide explosion-proof bands for television cathode-ray tubes or outer magnetic shielding materials using these high strength cold rolled steel sheets and high strength plated steel sheets. Cold rolled steel sheets and plated steel sheets refer to cold rolled steel sheets not subjected to surface treatment in the narrow sense which are used in domestic electrical appliances, including explosion-proof bands and support frames for television cathode-ray tubes, automobiles, furniture, building and other applications, and surface treated steel sheets, for example, plated steel sheets subjected to plating for rust preventive purposes, for example, electroplated steel sheets subjected to plating with zinc or zinc-nickel, galvanized steel sheets, and alloyed galvanized steel sheets, and plated steel sheets subjected to treatment for further improving press forming properties and rusting resistance, such as plated steel sheets subjected to alloying of the plating and plated steel sheets with an organic coating formed as an upper layer.

SUMMARY OF THE INVENTION

The present invention provides a high strength cold rolled steel sheet having improved geomagnetic shielding properties, that is, having a relative permeability of not less than 500 in a d.c. magnetic field of 0.3 Oe, comprising, by weight, carbon: 0.0003 to 0.0060%, silicon: 0.3 to 1.8%, manganese: 0.2 to 1.8%, phosphorus: not more than 0.12%, sulfur: 0.001 to 0.012%, aluminum: less than 0.005%, and nitrogen: not more than 0.0030%, provided that $\%Mn/\%S \geqq 60$, with the balance consisting of iron and unavoidable impurities, said high strength cold rolled steel sheet having a ferrite grain diameter of 10 to 200 $\mu$m in its metallographic structure (hereinafter referred to as "cold rolled steel sheet A").

The present invention further provides a high strength cold rolled steel sheet having improved geomagnetic shielding properties, that is, having a relative permeability of not less than 500 in a d.c. magnetic field of 0.3 Oe, comprising, by weight, carbon: 0.0003 to 0.0060%, silicon: 0.3 to 1.8%, manganese: 0.2 to 1.8%, phosphorus: not more than 0.12%, sulfur: 0.001 to 0.012%, aluminum: 0.005 to 0.04%, nitrogen: not more than 0.0030%, and boron: 0.0010 to 0.0030%, provided that $\%Mn/\%S \geqq 60$ and $\%B/\%N \geqq 0.5$, with the balance consisting of iron and unavoidable impurities, said high strength cold rolled steel sheet having a ferrite grain diameter of 10 to 200 $\mu$m in its metallographic structure (hereinafter referred to as "cold rolled steel sheet B").

The present invention further provides a high strength plated steel sheet having improved geomagnetic shielding properties, that is, having a relative permeability of not less than 500 in a d.c. magnetic field of 0.3 Oe, produced by electroplating a cold rolled steel sheet having the same chemical composition as the cold rolled steel sheet A or B with the content of silicon in the surface layer being not more than 5% by weight (hereinafter referred to as "plated steel sheet C or D").

The present invention further provides a process for producing a high strength cold rolled steel sheet having improved geomagnetic shielding properties, that is, having a relative permeability of not less than 500 in a d.c. magnetic field of 0.3 Oe, comprising the steps of: finish rolling a slab having the same chemical composition as the cold rolled steel sheet A or B at 750 to 980° C.; cold rolling the resultant plate with a reduction ratio of 60 to 90%; and, in a continuous annealing equipment, annealing the steel sheet in the temperature range of 750° C. to the $Ac_3$ point, or alternatively annealing the steel sheet followed by over aging at 300 to 450° C. for not less than 120 sec, thereby producing a high strength cold rolled steel sheet having a ferrite grain diameter of 10 to 200 μm in its metallographic structure.

The present invention further provides a process for producing a high strength electroplated steel sheet having improved geomagnetic shielding properties, that is, having a relative permeability of not less than 500 in a d.c. magnetic field of 0.3 Oe, produced by electroplating a cold rolled steel sheet with the content of silicon in the surface layer being not more than 5%, the process comprising the steps of: finish rolling a slab having the same chemical composition as the plated steel sheet C or D at 750 to 980° C.; coiling the resultant hoop at 700° C. or below; cold rolling the coil with a reduction ratio of 60 to 90%; and, in a continuous annealing equipment having an over aging zone, annealing the steel sheet in the temperature range of 750° C. to the $Ac_3$ point in a dew point of 0° C. or below, or alternatively annealing the steel sheet in the above manner followed by over aging at 300 to 450° C. for not less than 120 sec, thereby bringing the ferrite grain diameter in its metallographic structure to 10 to 200 μm.

The present invention further provides a process for producing a high strength electroplated steel sheet having improved geomagnetic shielding properties, that is, having a relative permeability of not less than 500 in a d.c. magnetic field of 0.3 Oe, produced by electroplating a cold rolled steel sheet with the content of silicon in the surface layer being not more than 5%, the process comprising the steps of: finish rolling a slab having the same chemical composition as the plated steel sheet C or D at 750 to 980° C.; cold rolling the resultant plate with a reduction ratio of 60 to 90%; and, in a continuous annealing equipment or in an in-line annealing type continuous galvanizing equipment, annealing the steel sheet in the temperature range of 750° C. to the $Ac_3$ point, or alternatively in a continuous annealing equipment having an over aging zone or in an in-line annealing type continuous galvanizing equipment, subjecting the steel sheet to annealing in the temperature range of 750° C. to the $Ac_3$ point and over aging at 300 to 450° C. for not less than 120 sec, thereby producing a high strength electroplated steel sheet having a ferrite grain diameter of 10 to 200 μm in its metallographic structure.

According to the present invention, high strength cold rolled steel sheets and high strength plated steel sheets and high strength plated steel sheets can be obtained which realize both high relative permeability in a d.c. magnetic field around 0.3 Oe corresponding to geomagnetism, that is, improved geomagnetic shielding properties, and high strength such as represented by yield strength. Further, they can be easily produced using the same continuous annealing equipment or in-line annealing type galvanizing equipment as used for the production of steel sheets for press working.

Further, when the steel sheets according to the present invention are applied to explosion-proof bands or support frames for television cathode-ray tubes, the effect of preventing the influence of perpendicular magnetic fields is much better than that of the conventional steel sheets, contributing greatly to an improvement in quality of television cathode-ray tubes. Furthermore, the steel sheets according to the present invention are applicable to a wide variety of applications where steel sheets are used, such as domestic electrical appliances, automobiles, furniture, and building. Therefore, the present invention is highly useful from the viewpoint of industry.

BEST MODE FOR CARRYING OUT THE INVENTION

Figure 1:
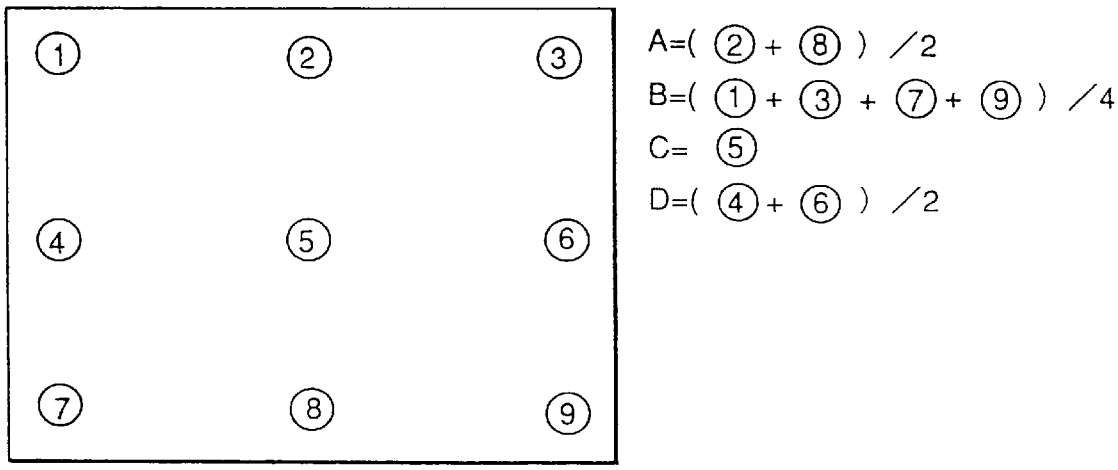
FIG. 1 is a diagram illustrating quadrants A to D in Table 4 (average value of color shifting in quadrants A to D formed by dividing the surface of a cathode-ray tube into four equal parts).

With a view to solving the above problems, the present inventors have noticed that solid solution strengthening of an ultra low carbon steel having a carbon content of not more than 0.0040% without relying upon precipitation strengthening and refinement of ferrite grains is crucial for realizing both increased relative permeability in a d.c. magnetic field around 0.3 Oe corresponding to geomagnetism and enhanced strength such as represented by yield point. The present inventors have made extensive and intensive studies and, as a result, have unexpectedly found that solid solution strengthening conducted mainly by silicon and manganese and, at the same time, deoxidation with silicon so as for substantially no aluminum to be left in the steel, or alternatively addition of boron in a given amount or larger in relation with the amount of nitrogen in the case of deoxidation with aluminum can provide a ferrite grain diameter of 10 to 30 μm and a relative permeability of not less than 500 in a d.c. magnetic field of 0.3 Oe, that is, improved geomagnetic shielding properties.

When the carbon content exceeds 0.0040%, the geomagnetic shielding properties are likely to deteriorate with age due to magnetic aging. On the other hand, when the amount of silicon and manganese added is large, it is not always easy to bring the carbon content to not more than 0.0040%. This unfavorably makes it difficult to further improve the geomagnetic shielding properties. The present inventors have made further studies with a view to solving these problems and, as a result, have found that bringing the ratio of the manganese content to the sulfur content to a given value or larger is effective in preventing the deterioration in geomagnetic shielding properties due to the magnetic aging with age. Further, they have found that, to this end, over aging at 300 to 450° C. for not less than 120 sec in the course of cooling to room temperature after annealing is preferred.

The present invention has been made based on such novel finding. The subject matters of the present invention are as follows.

(1) A high strength cold rolled steel sheet having improved geomagnetic shielding properties, comprising, by weight, carbon: 0.0003 to 0.0060%, silicon: 0.3 to 1.8%, manganese: 0.2 to 1.8%, phosphorus: not more than 0.12%, sulfur: 0.001 to 0.012%, aluminum: less than 0.005%, and nitrogen: not more than 0.0030%, provided that $\%Mn/\%S \geqq 60$ wherein %Mn represents the manganese content and %S represents the sulfur content, with the balance consisting of iron and unavoidable impurities, said high strength cold rolled steel sheet having a ferrite grain diameter of 10 to 200 μm in its metallographic structure and a relative permeability of not less than 500 in a d.c. magnetic field of 0.3 Oe.

(2) A high strength cold rolled steel sheet having improved geomagnetic shielding properties, comprising, by weight, carbon: 0.0003 to 0.0060%, silicon: 0.3 to 1.8%, manganese: 0.2 to 1.8%, phosphorus: not more than 0.12%, sulfur: 0.001 to 0.012%, aluminum: 0.005 to 0.04%, nitrogen: not more than 0.0030%, and boron: 0.0010 to 0.0030%, provided that %Mn/%S≧60 and %B/%N≧0.5 wherein %Mn represents the manganese content, %S represents the sulfur content, %N represents the nitrogen content, and %B represents the boron content, with the balance consisting of iron and unavoidable impurities, said high strength cold rolled steel sheet having a ferrite grain diameter of 10 to 200 μm in its metallographic structure and a relative permeability of not less than 500 in a d.c. magnetic field of 0.3 Oe.

(3) A high strength electroplated steel sheet having improved geomagnetic shielding properties according to the above item (1) or (2), wherein the relative permeability is not less than 500 in a d.c. magnetic field of 0.3 Oe, said high strength electroplated steel sheet having been produced by electroplating a cold rolled steel sheet with the silicon content of the surface layer being not more than 5%.

(4) A high strength plated (coated) steel sheet having improved geomagnetic shielding properties according to the above item (1) or (2), wherein the relative permeability is not less than 500 in a d.c. magnetic field of 0.3 Oe.

(5) An explosion-proof band or an outer magnetic shielding material for a television cathode-ray tube using the steel sheet according to the above item (1), (2), (3), or (4).

(6) A process for producing a high strength cold rolled steel sheet having improved geomagnetic shielding properties, comprising the steps of: finish rolling a slab having the chemical composition described in the above item (1) or (2) at 750 to 980° C.; cold rolling the resultant plate with a reduction ratio of 60 to 90%; and, in a continuous annealing equipment, subjecting the cold rolled plate to annealing in the temperature range of 750° C. to the $Ac_3$ point to produce a high strength cold rolled steel sheet having a ferrite grain diameter of 10 to 200 μm in its metallographic structure and a relative permeability of not less than 500 in a d.c. magnetic field of 0.3 Oe.

(7) A process for producing a high strength cold rolled steel sheet having improved geomagnetic shielding properties, comprising the steps of: finish rolling a slab having the chemical composition described in the above item (1) or (2) at 750 to 980° C.; cold rolling the resultant plate with a reduction ratio of 60 to 90%; and, in a continuous annealing equipment having an over aging zone, subjecting the steel sheet to annealing in the temperature range of 750° C. to the $Ac_3$ point and to over aging at 300 to 450° C. for not less than 120 sec to produce a high strength cold rolled steel sheet having a ferrite grain diameter of 10 to 200 μm in its metallographic structure and a relative permeability of not less than 500 in a d.c. magnetic field of 0.3 Oe.

(8) A process for producing a high strength electroplated steel sheet having improved geomagnetic shielding properties, comprising the steps of: finish rolling a slab having the chemical composition described in claim (3) at 750 to 980° C.; coiling the resultant hoop (strip) at 700° C. or below; cold rolling the coil with a reduction ratio of 60 to 90%; and, in a continuous annealing equipment, subjecting the steel sheet to annealing in the temperature range of 750° C. to the $Ac_3$ point in a dew point of 0° C. or below to produce a cold rolled steel sheet having a ferrite grain diameter of 10 to 200 μm in its metallographic structure and a surface layer silicon content of not more than 5%; and electroplating the cold rolled steel sheet to produce a high strength electroplated steel sheet having a relative permeability of not less than 500 in a d.c. magnetic field of 0.3 Oe.

(9) A process for producing a high strength electroplated steel sheet having improved geomagnetic shielding properties, comprising the steps of: finish rolling a slab having the chemical composition described in the above item (3) at 750 to 980° C.; coiling the resultant strip at 700° C. or below; cold rolling the coil with a reduction ratio of 60 to 90%; and, in a continuous annealing equipment having an over aging zone, annealing the steel sheet in the temperature range of 750° C. to the $Ac_3$ point in a dew point of 0° C. or below and subsequently subjecting the annealed sheet to over aging at 300 to 450° C. for not less than 120 sec to produce a cold rolled steel sheet having a ferrite grain diameter of 10 to 200 μm in its metallographic structure and a surface layer silicon content of not more than 5%; and electroplating the cold rolled steel sheet to produce a high strength electroplated steel sheet having a relative permeability of not less than 500 in a d.c. magnetic field of 0.3 Oe.

(10) A process for producing a high strength plated steel sheet having improved geomagnetic shielding properties, comprising the steps of: finish rolling a slab having the chemical composition described in the above item (4) at 750 to 980° C.; cold rolling the resultant plate with a reduction ratio of 60 to 90%; and, in a continuous annealing equipment or in an in-line annealing type continuous galvanizing equipment, annealing the steel sheet in the temperature range of 750° C. to the $Ac_3$ point to produce a high strength plated steel sheet having a ferrite grain diameter of 10 to 200 μm in its metallographic structure and a relative permeability of not less than 500 in a d.c. magnetic field of 0.3 Oe.

(11) A process for producing a high strength plated steel sheet having improved geomagnetic shielding properties, comprising the steps of: finish rolling a slab having the chemical composition described in the above item (4) at 750 to 980° C; cold rolling the resultant plate with a reduction ratio of 60 to 90%; and, in a continuous annealing equipment having an over aging zone or in an in-line annealing type continuous galvanizing equipment, subjecting the cold rolled plate to annealing in the temperature range of 750° C. to the $Ac_3$ point and over aging at 300 to 450° C. for not less than 120 sec to produce a high strength plated steel sheet having a ferrite grain diameter of 10 to 200 μm in its metallographic structure and a relative permeability of not less than 500 in a d.c. magnetic field of 0.3 Oe.

The present invention will be described in more detail.

At the outset, the reasons for the numerical limitation of carbon, silicon, manganese, phosphorus, sulfur, aluminum, boron, and nitrogen as main additive elements will be described.

Carbon is an element that is very important for enhancing the yield point by solid solution strengthening or precipitation strengthening. Even though the proportion of the manganese content to the sulfur content is brought to a given value as in the feature of the present invention, geomagnetic shielding properties are deteriorated due to precipitation of fine carbides involved in aging, when the carbon content exceeds 0.0040% if over aging is not carried out, or when the carbon content exceeds 0.0060% even though over aging at 300 to 450° C. for not less than 120 sec is carried out in the course of cooling to room temperature after annealing. On the other hand, a carbon content of less than 0.0003% necessitates a very long period of time for vacuum degassing, unfavorably resulting in remarkably increased production cost.

Silicon is dissolved as a solid solution in grains without significantly changing the diameter of ferrite grains to replace iron atoms. This distorts crystal lattices to enhance the yield point. On the other hand, silicon does not significantly affect geomagnetic shielding properties and hence is added in an amount of not less than 0.3% from the viewpoint of enhancing the yield point. In particular, when the carbon content has been brought to not more than 0.0040% from the viewpoint of omitting over aging, addition of silicon in an amount of not less than 1.0% is preferred in order to bring the yield point to more than 300 MPa. Addition of silicon in an amount exceeding 1.8% results in the formation of an internal oxide layer as the surface layer of the steel sheet that is causative of surface defects. Further, an $SiO_2$ coating is formed as the surface layer, and, when galvanizing is carried out, this deteriorates the adhesion of plating and, in addition, remarkably deteriorates the suitability for electroplating.

Manganese, as with silicon, is dissolved as a solid solution in grains without significantly changing the diameter of ferrite grains to replace iron atoms. This distorts crystal lattices to enhance the yield point. On the other hand, manganese does not significantly affect geomagnetic shielding properties and hence is added in an amount of not less than 0.2% from the viewpoint of enhancing the yield point. Addition of manganese in an amount exceeding 1.8%, however, results in significantly refined ferrite grains. This leads to significantly deteriorated geomagnetic shielding properties, and very high cost is required for achieving a combination of good geomagnetic shielding properties with a carbon content falling within the scope of the present invention. Further, $\%Mn/\%S \geqq 60$, wherein %Mn represents the manganese content and %S represents the sulfur content, should be satisfied from the viewpoint of preventing the deterioration of geomagnetic shielding properties by aging. In the case of $\%Mn/\%S \leqq 60$, geomagnetic shielding properties are deteriorated by aging, as can be understood from the fact that, independently of the carbon content and of whether or not over aging is carried out, for example, aging at 200° C. for 2 hr results in significantly lowered relative permeability.

Phosphorus refines ferrite grains and hence has more significant adverse effect on geomagnetic shielding properties as compared with silicon and manganese which are the same solid solution strengthening elements. In particular, when the strength at yield point should be enhanced, phosphorus may be added in an amount up to 0.12% because, as compared with precipitation strengthening or work strengthening, a deterioration in geomagnetic shielding properties is more acceptable. When the amount of phosphorus added exceeds 0.12%, the refinement of ferrite grains is significant. This remarkably deteriorates geomagnetic shielding properties and, in addition, due to significant center segregation, deteriorates cold rollability. In ultra low carbon steel sheets like those according to the present invention, addition of a large amount of phosphorus in combination with silicon renders the steel sheet very brittle. In order to avoid this, phosphorus is preferably added in an amount of not more than $(0.12-0.04\times\%Si)\%$ wherein %Si represents the amount of silicon added.

Sulfur forms MnS which inhibits movement of magnetic domain walls and at the same time inhibits the growth of ferrite grains. This deteriorates the geomagnetic shielding properties. For this reason, the upper limit of the sulfur content is 0.012%. On the other hand, a sulfur content of less than 0.001% unfavorably brings about significantly increased production cost.

Aluminum is generally used for deoxidation of steels. Aluminum, however, precipitates as fine AlN which inhibits movement of magnetic domain walls and at the same time inhibits the growth of ferrite grains. This deteriorates the geomagnetic shielding properties. For this reason, use of aluminum in an amount in excess of that required for the capture of oxygen is unfavorable, and the amount of aluminum added is limited to less than 0.05% so that aluminum is substantially absent in the steel. When silicon is added, addition thereof in an amount of less than 0.005% sometimes causes highly increased cost. When boron is added in a given amount or larger in relation with the amount of nitrogen, this adverse effect does not occur. For this reason, addition of aluminum in an amount of not less than 0.005% for satisfactory deoxidation is preferred from the viewpoint of improving the surface properties. On the other hand, addition of aluminum in an amount exceeding 0.04% has significant adverse effect on geomagnetic shielding properties and at the same time results in deteriorated surface properties.

Nitrogen inhibits, as fine precipitates, the movement of magnetic domain walls and deteriorates geomagnetic shielding properties. For this reason, the nitrogen content is limited to not more than 0.0030%. Further, nitrogen combines with aluminum to form a compound which inhibits the movement of magnetic domain walls and at the same time inhibits the growth of ferrite grains. Therefore, according to the present invention, when aluminum is present in the steel, boron is particularly added to precipitate boron as BN, thereby inhibiting the deterioration of geomagnetic shielding properties.

Boron is an element that, when aluminum is present in the steel, plays a very important role. Specifically, boron is added to form BN which inhibits the precipitation of fine AlN and improves the geomagnetic shielding properties. This purpose is attained when the amount of boron added is not less than 0.0010% with $\%B/\%N \geqq 0.5$ wherein %N represents the nitrogen content and %B represents the boron content. On the other hand, addition of boron in an amount exceeding 0.0030% should be avoided because this inhibits the growth of ferrite grains and rather deteriorates the geomagnetic shielding properties.

Titanium, niobium, copper, tin, zinc, zirconium, molybdenum, tungsten, chromium, nickel and the like are contained as unavoidable impurities. These elements are unfavorable from the viewpoint of achieving both good geomagnetic shielding properties and high strength contemplated in the present invention. The total content of these elements is preferably less than 0.3%.

Next, the reasons for the limitation of conditions for the production of steel sheets according to the present invention will be described.

Any slab may be used without particular limitation for hot rolling. Specific examples thereof-include continuous-cast slabs and slabs produced by thin slab caster and the like. Further, the present invention is compatible with such processes as continuous casting-direct rolling (CC-DR) wherein hot rolling is carried out immediately after casting. Conditions for hot rolling is not particularly limited.

The finishing temperature of hot rolling is 750 to 980° C. When the finishing temperature is below 750° C., a structure in unrecrystallized state is left and deteriorates cold rollability. Further, in this case, it is not easy to bring the size of ferrite grains of the cold rolled and annealed steel sheet to not less than 10 $\mu$m, and the magnetic shielding properties are poor. On the other hand, when finishing of the hot rolling at a temperature above 980° C. is contemplated, the heating temperature should be unfavorably remarkably raised. The finishing temperature is particularly preferably 800° C. to the $Ar_3$ point from the viewpoint of facilitating the growth of ferrite grains after cold rolling and annealing. The cooling method after hot rolling and the coiling temperature are not particularly limited. However, when galvanizing is carried out because of unsatisfactory pickling due to increased scale thickness and enrichment of silicon on the surface layer, the coiling temperature is preferably 700° C. or below from the viewpoint of preventing a deterioration in adhesion of plating and a significant deterioration in suitability for electroplating.

Cold rolling may be carried out under conventional conditions. The reduction ratio is not less than 60% particularly from the viewpoint of efficiently removing scale by pickling. On the other hand, cold rolling with a reduction ratio exceeding 90% is unrealistic because a large cold rolling load is necessary.

When annealing is carried out in a continuous annealing equipment or an in-line annealing type continuous galvanizing equipment, the annealing temperature is 750° C. to the $Ac_3$ point. When the annealing temperature is below 750° C., the recrystallization is unsatisfactory. In this case, the working structure is left, resulting in significantly deteriorated geomagnetic shielding properties. The geomagnetic shielding properties improve with an increase in the annealing temperature and the growth of ferrite grains. Annealing at a temperature above the $Ac_3$ point, however, should be avoided because this sometimes creates a mixed grain structure due to transformation and deteriorates the geomagnetic shielding properties. In particular, when the silicon content is high, silicon is enriched on the surface layer at the time of annealing. When the silicon content in the surface layer reaches 5% or more, the suitability for electroplating is deteriorated. For this reason, the annealing is preferably carried out at dew point 0° C. or below. When the carbon content exceeds 0.0040%, the geomagnetic shielding properties are likely to be deteriorated due to magnetic aging with age. Therefore, preferably, over aging is carried out at 300 to 450° C. for not less than 120 sec in the course of cooling to room temperature after the annealing. When the over aging temperature exceeds 450° C. or when the over aging time is less than 120 sec, the precipitation of carbon is unsatisfactory. In this case, carbides are finely precipitated during use at room temperature, leading to a deterioration in geomagnetic shielding properties with age. On the other hand, when the over aging temperature is below 300° C., precipitated carbides are refined during over aging. In this case, the geomagnetic shielding properties are unsatisfactory, even immediately after the production of the steel sheet.

Subsequent optional surface treatment for rust preventive purposes, such as zinc plating and alloy plating including zinc-nickel plating, and the provision of an organic film on the plating, do not influence geomagnetic shielding properties which are the feature of the present invention.

After the annealing, temper rolling and shearing and working of the steel sheet into contemplated shapes of components lower the relative permeability in a d.c. magnetic field around 0.3 Oe. Since, however, explosion-proof bands and support frames of television cathode-ray tubes are used in the state of being compressed by heat shrinkage created upon forced cooling from about 600° C., that is, in the shrink fitted state, most of applied strains is released in the course of reheating to 600° C. Therefore, the geomagnetic shielding property, that is, the relative permeability in a d.c. magnetic field around 0.3 Oe is not significantly different from that found immediately after the annealing. That is, both improved geomagnetic shielding properties and high strength such as represented by the yield point can be realized.

EXAMPLES

Example 1

Steels having chemical compositions indicated in Table 1 were hot rolled to a thickness of 3.0 to 6.0 mm under conditions indicated in Table 2, pickled, and cold rolled to produce 0.7 to 1.6 mm-thick cold rolled steel strips. The cold rolled steel strips were heat treated in a continuous annealing equipment under conditions indicated in Table 2 and further temper rolled with an elongation of 0.3%. JIS No. 5 test pieces were taken off from the steel strips, thus obtained, in a direction parallel to the rolling direction and subjected to a tensile test at room temperature to determine yield strength (YP) and tensile strength (TS). Further, samples having a size of 30 mm×300 mm taken off from the same steel strips were combined to determine the relative permeability in a d.c. magnetic field of 0.3 Oe by the d.c. Epstein method according to JIS C 2550. Furthermore, the relative permeability was measured again after aging at 200° C. for 2 hr to investigate a change in relative permeability with age. Further, a section was corroded and then observed under an optical microscope at a magnification of 100 times to determine the average particle diameter of ferrite grains. The results are summarized in Table 2.

As is apparent from Table 2, sample Nos. 1, 2, 4, 7, 8, 10, 12, 19, 27, 28, 31, 33, and 35, which have chemical compositions specified in the present invention and have a ferrite grain diameter of 10 to 200 $\mu$m, have a yield point of not less than 300 MPa and at the same time have a relative permeability of not less than 500 in a d.c. magnetic field of 0.3 Oe. In this case, they caused no aging deterioration. Therefore, it is apparent that these samples have both high strength and improved geomagnetic shielding properties. By contrast, even though the steel sheet has a chemical composition falling within the scope of the present invention and has been produced under proper hot rolling and cold rolling conditions with a proper annealing temperature, unproper over aging results in poor geomagnetic shielding properties in the case of a carbon content exceeding 0.0040%. Regarding these samples, for example, sample No. 32, even immediately after the production thereof, has low relative permeability and poor geomagnetic shielding properties, or otherwise, as can be understood from sample Nos. 25, 26, 29, and 34, even when the relative permeability is relatively large immediately after the production, the geomagnetic shielding properties appear to deteriorate with age.

Even in the case of a chemical composition specified in the present invention, when, as can be understood from sample Nos. 9, 11, 15, 30, and 36, the steel sheet has a ferrite grain diameter not in the range of 10 to 200 $\mu$m due to improper production conditions and, in particular, contains unrecrystallized grains or has a mixed grain structure, the steel sheet has a relative permeability of less than 500 in a d.c. magnetic field of 0.3 Oe and does not have improved geomagnetic shielding properties. For sample Nos. 5, 6, 13, and 14 wherein the content of silicon in the surface layer exceeds 5%, the suitability for electroplating is very poor.

On the other hand, for sample Nos. 7 and 37 wherein the %Mn/%S value is less than 60, even after over aging according to the present invention, the relative permeability significantly deteriorates with age. For sample No. 24 wherein the silicon content is high, although the chemical composition is outside the scope of the present invention, this sample steel has high yield point and large relative permeability, and does not undergo a deterioration in relative permeability with age, but on the other hand, the suitability for electroplating is poor, making it impossible to extensively utilize this steel sheet as industrial products. Regarding other steels outside the scope of the present invention, sample Nos. 16 and 17 have a relative permeability of not less than 500 in a d.c. magnetic field of 0.3 Oe, but on the other hand, it is difficult to provide a yield point of not less than 300 MPa; sample Nos. 18 and 20 to 23 have a yield point of not less than 300 MPa, but on the other hand, they do not have improved geomagnetic shielding properties due to the difficulty of bringing the ferrite grain diameter to 10 to 200 μm; and sample No. 38, which has a carbon content exceeding 0.0060%, has a relative permeability of less than 500 in a d.c. magnetic field of 0.3 Oe and hence does not have improved geomagnetic shielding properties.

Example 2

Steels C and D having chemical compositions indicated in Table 1 were hot rolled to a thickness of 4.5 to 6.0 mm under conditions indicated in Table 3, pickled, cold rolled to produce 1.0 to 1.6 mm-thick cold rolled steel strips. The cold rolled steel strips in their surface layer were then galvanized using an in-line annealing type continuous galvanizing equipment while performing heat treatment under conditions indicated in Table 2, followed by temper rolling with an elongation of 0.3%. JIS No. 5 test pieces were taken off from the steel strips, thus obtained, in a direction parallel to the rolling direction and subjected to a tensile test at room temperature to determine yield strength (YP) and tensile strength (TS). Further, samples having a size of 30 mm×300 mm taken off from the same strips were combined to determine the relative permeability in a d.c. magnetic field of 0.3 Oe by the d.c. Epstein method according to JIS C 2550. Furthermore, the relative permeability was measured again after aging at 200° C. for 2 hr to investigate a deterioration in relative permeability with age. Further, a section was corroded and then observed under an optical microscope at a magnification of 100 times to determine the average particle diameter of ferrite grains. The results are summarized in Table 3.

As is apparent from Table 3, sample Nos. 1, 2, 4, and 5, which have chemical compositions specified in the present invention and have a ferrite grain diameter of 10 to 200 μm, are high strength cold rolled steel sheets having a yield point of not less than 300 MPa, and at the same time have a relative permeability of not less than 500 in a d.c. magnetic field of 0.3 Oe and improved geomagnetic shielding properties. By contrast, even in the case of a chemical composition specified in the present invention, when, as can be understood from sample Nos. 3 and 6, the steel sheet has a ferrite grain diameter not in the range of 10 to 200 μm due to improper production conditions and, in particular, contains unrecrystallized grains or has a mixed grain structure, the steel sheet has a relative permeability of less than 500 in a d.c. magnetic field of 0.3 Oe and does not have improved geomagnetic shielding properties.

Example 3

Electroplated steel sheets were produced using steel G (steel of the present invention) and steel Q (comparative steel) indicated in Table 1 under production conditions indicated in sample No. 12 (example of the present invention) and sample No. 30 (comparative example) shown in Table 2. The electroplated steel sheets were applied to explosion-proof bands or outer magnetic shielding materials for television cathode-ray tubes to evaluate geomagnetic shielding properties.

The geomagnetic shielding properties were evaluated by the following method.

Under such an environment that a vertical magnetic field of 0.35 Oe and a horizontal magnetic field of 0.3 Oe have been applied, the direction of the television cathode-ray tubes was changed to the east, the west, the south, and the north in that order. In this case, the color shift of electron beams from the reference point in each direction, Bh, and the color shift of electron beams upon a change in vertical time to 0.35 Oe with the horizontal magnetic field being 0 Oe, Bv, were determined. For each of Bh and Bv, the smaller the absolute value, the smaller the color shift and the better the geomagnetic shielding properties of the television cathode-ray tube.

The results of the evaluation on the geomagnetic shielding properties are summarized in Table 4. As is apparent from the results shown in Table 4, all the absolute values of Bh and Bv for quadrants A to D in explosion-proof bands for 21-inch and 36-inch television cathode-ray tubes according to the examples of the present invention are smaller than those for the comparative examples, indicating that the steel sheets according to the present invention have improved geomagnetic shielding properties. The above results confirm that the television cathode-ray tubes according to the present invention create no significant color shift and possess improved geomagnetic shielding properties.

Details of the quadrants A to D shown in Table 4 are explained in FIG. 1. In Table 4, the improvement was determined by the equation: Improvement (%)=(Comparative Example−Example of Invention)/Comparative Example×100.

TABLE 1

| Type of | Chemical composition, wt % | | | | | | | | | | |
|---|---|---|---|---|---|---|---|---|---|---|---|
| steel | C | Si | Mn | P | S | Al | N | B | Mn/S | B/N | Example |
| A | 0.0009 | 1.41 | 0.63 | 0.056 | 0.0064 | 0.002 | 0.0017 | — | 98.4 | — | Inv. |
| B | 0.0017 | 0.85 | 0.56 | 0.083 | 0.0105 | 0.001 | 0.0017 | — | 53.3 | — | Comp. |
| C | 0.0016 | 1.10 | 1.00 | 0.053 | 0.0035 | 0.038 | 0.0022 | 0.0023 | 285.7 | 1.0 | Inv. |
| D | 0.0018 | 1.01 | 1.02 | 0.078 | 0.0048 | 0.003 | 0.0016 | — | 212.5 | — | Inv. |
| E | 0.0022 | 1.73 | 0.88 | 0.050 | 0.0065 | 0.001 | 0.0025 | — | 135.4 | — | Inv. |
| F | 0.0025 | 1.23 | 1.36 | 0.043 | 0.0080 | 0.034 | 0.0019 | 0.0011 | 170.0 | 0.6 | Inv. |
| G | 0.0026 | 1.39 | 0.81 | 0.039 | 0.0057 | 0.004 | 0.0022 | — | 142.1 | — | Inv. |
| H | 0.0027 | 0.24 | 0.92 | 0.053 | 0.0076 | 0.021 | 0.0025 | 0.0014 | 121.1 | 0.6 | Comp. |

TABLE 1-continued

| Type of steel | Chemical composition, wt % C | Si | Mn | P | S | Al | N | B | Mn/S | B/N | Example |
|---|---|---|---|---|---|---|---|---|---|---|---|
| I | 0.0028 | 1.18 | 0.15 | 0.039 | 0.0051 | 0.002 | 0.0024 | — | 29.4 | — | Comp. |
| J | 0.0029 | 1.23 | 2.07 | 0.047 | 0.0097 | 0.045 | 0.0023 | 0.0015 | 212.4 | 0.7 | Comp. |
| K | 0.0029 | 0.70 | 1.53 | 0.052 | 0.0037 | 0.039 | 0.0020 | 0.0012 | 425.0 | 0.6 | Inv. |
| L | 0.0030 | 0.65 | 1.41 | 0.135 | 0.0092 | 0.032 | 0.0021 | 0.0014 | 153.3 | 0.7 | Comp. |
| M | 0.0032 | 0.67 | 1.47 | 0.062 | 0.0051 | 0.065 | 0.0028 | — | 288.2 | — | Comp. |
| N | 0.0032 | 0.73 | 1.48 | 0.069 | 0.0067 | 0.036 | 0.0018 | 0.0004 | 220.9 | 0.2 | Comp. |
| O | 0.0034 | 0.71 | 1.39 | 0.051 | 0.0042 | 0.025 | 0.0026 | 0.0042 | 331.0 | 1.6 | Comp. |
| P | 0.0036 | 1.83 | 0.88 | 0.039 | 0.0036 | 0.002 | 0.0023 | — | 244.4 | — | Comp. |
| Q | 0.0042 | 1.39 | 0.25 | 0.034 | 0.0038 | 0.042 | 0.0028 | 0.0017 | 65.8 | 0.6 | Inv. |
| R | 0.0047 | 0.88 | 1.61 | 0.052 | 0.0045 | 0.002 | 0.0027 | — | 357.8 | — | Inv. |
| S | 0.0052 | 1.15 | 0.45 | 0.069 | 0.0092 | 0.035 | 0.0016 | 0.0014 | 48.9 | 0.9 | Comp. |
| T | 0.0085 | 1.19 | 1.46 | 0.052 | 0.0077 | 0.002 | 0.0018 | — | 189.6 | — | Comp. |

Note: Underlined values are outside the scope of the present invention.
Inv.: Present invention
Comp.: Comparative Example

TABLE 2

| Sample No. | Type of steel | Hot roll finishing temp., ° C. | Coiling temp., ° C. | Thickness of hot roll finished plate, mm | Product thickness, mm | Cold rolling degree, % | Annealing temp., ° C. | Dew point during annealing, ° C. | Over aging temp., ° C. | Over aging time, sec |
|---|---|---|---|---|---|---|---|---|---|---|
| 1 | A | 890 | 640 | 4.0 | 1.0 | 75 | 820 | −5 | 360–430 | 130 |
| 2 | A | 880 | 650 | 6.0 | 1.0 | 84 | 880 | −5 | 380–430 | 200 |
| 3 | B | 910 | 630 | 4.0 | 1.2 | 70 | 780 | −10 | 360–430 | 130 |
| 4 | E | 810 | 590 | 4.5 | 1.2 | 73 | 840 | −5 | 360–440 | 220 |
| 5 | E | 820 | 550 | 4.0 | 1.0 | 75 | 840 | 20 | 360–410 | 140 |
| 6 | E | 850 | 730 | 3.5 | 1.0 | 71 | 860 | 10 | 370–430 | 160 |
| 7 | F | 850 | 600 | 3.5 | 0.8 | 77 | 880 | −15 | 360–410 | 160 |
| 8 | F | 870 | 620 | 4.5 | 1.0 | 78 | 840 | −5 | 460–480 | 160 |
| 9 | F | 870 | 620 | 4.5 | 1.2 | 73 | 960 | −10 | 370–410 | 160 |
| 10 | F | 960 | 580 | 4.0 | 1.0 | 75 | 880 | −5 | 370–440 | 180 |
| 11 | F | 730 | 570 | 6.0 | 1.4 | 77 | 880 | −5 | 350–380 | 150 |
| 12 | G | 870 | 640 | 6.0 | 1.6 | 73 | 880 | −5 | 320–390 | 140 |
| 13 | G | 870 | 640 | 6.0 | 1.6 | 73 | 840 | 30 | 350–420 | 150 |
| 14 | G | 900 | 760 | 4.5 | 1.2 | 73 | 860 | −5 | 340–380 | 250 |
| 15 | G | 910 | 650 | 6.0 | 1.2 | 80 | 740 | −10 | 370–430 | 150 |
| 16 | H | 830 | 640 | 4.0 | 1.2 | 70 | 880 | −0 | 330–390 | 150 |
| 17 | I | 880 | 680 | 4.0 | 1.0 | 75 | 880 | −15 | 360–410 | 180 |
| 18 | J | 830 | 610 | 4.5 | 0.8 | 82 | 880 | −5 | 350–400 | 150 |
| 19 | K | 830 | 600 | 4.0 | 1.2 | 70 | 880 | −5 | 350–390 | 130 |
| 20 | L | 880 | 530 | 5.0 | 1.4 | 72 | 880 | −5 | 350–390 | 150 |
| 21 | M | 830 | 590 | 4.0 | 1.0 | 75 | 880 | −10 | 350–380 | 140 |
| 22 | N | 830 | 660 | 5.0 | 1.6 | 68 | 880 | −5 | 370–390 | 160 |
| 23 | O | 830 | 570 | 3.0 | 0.7 | 77 | 880 | −5 | 350–420 | 180 |
| 24 | P | 810 | 640 | 3.5 | 1.2 | 66 | 840 | −5 | 360–410 | 160 |
| 25 | Q | 850 | 650 | 4.0 | 1.0 | 75 | 820 | −15 | 360–420 | 80 |
| 26 | Q | 850 | 650 | 4.0 | 1.2 | 70 | 800 | −10 | 480–530 | 250 |
| 27 | Q | 850 | 620 | 3.5 | 1.0 | 71 | 820 | −20 | 320–390 | 140 |
| 28 | Q | 880 | 610 | 4.5 | 1.6 | 64 | 900 | −5 | 320–390 | 180 |
| 29 | Q | 880 | 570 | 4.0 | 0.8 | 80 | 820 | −5 | 180–250 | 180 |
| 30 | Q | 880 | 600 | 4.5 | 1.2 | 73 | 700 | −10 | 370–430 | 150 |
| 31 | R | 830 | 560 | 4.5 | 1.2 | 73 | 880 | −10 | 350–390 | 150 |
| 32 | R | 830 | 540 | 4.5 | 1.2 | 73 | 880 | −5 | 200–260 | 170 |
| 33 | R | 830 | 640 | 4.5 | 1.2 | 73 | 800 | −20 | 350–380 | 140 |
| 34 | R | 840 | 630 | 5.5 | 1.6 | 71 | 860 | −10 | 350–410 | 60 |
| 35 | R | 930 | 600 | 4.0 | 1.0 | 75 | 880 | −15 | 350–420 | 180 |
| 36 | R | 730 | 550 | 4.0 | 0.8 | 80 | 860 | −5 | 380–440 | 130 |
| 37 | S | 890 | 620 | 5.5 | 1.2 | 78 | 820 | −10 | 350–400 | 150 |
| 38 | T | 830 | 580 | 4.5 | 1.2 | 73 | 880 | −5 | 380–440 | 130 |

| Sample No. | Type of steel | Grain diameter, μm | Yield point, MPa | Tensile strength, MPa | Elongation, % | Relative permeability | Relative permeability after aging under 200° C. × 2 hr | Si content of surface layer, % | Suitability for electroplating | Example |
|---|---|---|---|---|---|---|---|---|---|---|
| 1 | A | 22 | 329 | 485 | 37 | 680 | 670 | 2 | Good | Inv. |
| 2 | A | 25 | 326 | 478 | 38 | 690 | 690 | 1.9 | Good | Inv. |
| 3 | B | 15 | 334 | 465 | 37 | 530 | 480 | 1.1 | Good | Comp. |
| 4 | E | 26 | 366 | 510 | 37 | 590 | 600 | 2.5 | Good | Inv. |
| 5 | E | 25 | 369 | 509 | 36 | 540 | 540 | 6.4 | No good | Comp. |
| 6 | E | 21 | 373 | 510 | 36 | 510 | 500 | 5.4 | No good | Comp. |
| 7 | F | 22 | 337 | 488 | 39 | 660 | 650 | 1.3 | Good | Inv. |

TABLE 2-continued

| | | | | | | | | | | |
|---|---|---|---|---|---|---|---|---|---|---|
| 8 | F | 18 | 345 | 494 | 36 | 540 | 420 | 1.9 | Good | Inv. |
| 9 | F | 8 | 325 | 497 | 41 | 470 | 470 | 1.5 | Good | Comp. |
| 10 | F | 19 | 342 | 495 | 39 | 590 | 580 | 1.8 | Good | Inv. |
| 11 | F | 8 | 455 | 633 | 7 | 150 | 150 | 1.7 | Good | Comp. |
| 12 | G | 27 | 347 | 496 | 39 | 620 | 600 | 2.2 | Good | Inv. |
| 13 | G | 23 | 357 | 500 | 37 | 560 | 540 | 6.2 | No good | Comp. |
| 14 | G | 18 | 365 | 502 | 36 | 520 | 500 | 5.1 | No good | Comp. |
| 15 | G | 7 | 480 | 587 | 14 | 400 | 390 | 2 | Good | Comp. |
| 16 | H | 28 | 235 | 360 | 48 | 650 | 640 | 0.3 | Good | Comp. |
| 17 | I | 29 | 296 | 432 | 43 | 680 | 670 | 1.4 | Good | Comp. |
| 18 | J | 7 | 349 | 525 | 35 | 450 | 430 | 1.8 | Good | Comp. |
| 19 | K | 29 | 302 | 449 | 43 | 780 | 760 | 1.1 | Good | Inv. |
| 20 | L | 8 | 341 | 502 | 36 | 410 | 400 | 0.8 | Good | Comp. |
| 21 | M | 7 | 309 | 458 | 43 | 430 | 430 | 0.8 | Good | Comp. |
| 22 | N | 9 | 312 | 464 | 44 | 480 | 470 | 1.2 | Good | Comp. |
| 23 | O | 7 | 335 | 496 | 37 | 420 | 420 | 1 | Good | Comp. |
| 24 | P | 28 | 371 | 516 | 33 | 670 | 680 | 5.2 | No good | Comp. |
| 25 | Q | 29 | 334 | 471 | 36 | 790 | 490 | 1.5 | Good | Comp. |
| 26 | Q | 26 | 335 | 472 | 35 | 730 | 470 | 1.7 | Good | Comp. |
| 27 | Q | 30 | 330 | 472 | 36 | 810 | 800 | 1.3 | Good | Inv. |
| 28 | Q | 38 | 326 | 465 | 38 | 1060 | 1060 | 2 | Good | Inv. |
| 29 | Q | 28 | 334 | 476 | 35 | 650 | 450 | 1.9 | Good | Comp. |
| 30 | Q | 5 | 495 | 633 | 9 | 140 | 140 | 1.6 | Good | Comp. |
| 31 | R | 28 | 308 | 453 | 38 | 780 | 790 | 1.2 | Good | Inv. |
| 32 | R | 20 | 313 | 453 | 37 | 490 | 410 | 1.4 | Good | Comp. |
| 33 | R | 16 | 332 | 461 | 37 | 580 | 580 | 0.9 | Good | Inv. |
| 34 | R | 25 | 319 | 455 | 37 | 670 | 460 | 1.1 | Good | Comp. |
| 35 | R | 24 | 312 | 450 | 37 | 640 | 660 | 1 | Good | Inv. |
| 36 | R | 7 | 343 | 463 | 35 | 360 | 340 | 1.2 | Good | Comp. |
| 37 | S | 17 | 311 | 435 | 39 | 660 | 460 | 1.5 | Good | Comp. |
| 38 | T | 18 | 414 | 545 | 32 | 320 | 270 | 1.7 | Good | Comp. |

Note: Underlined values are outside the scope of the invention.

TABLE 3

| Sample No. | Type of steel | Hot roll finishing temp., ° C. | Thickness of hot roll finished plate, mm | Product thickness, mm | Cold rolling degree, % | Annealing temp., ° C. | Over aging temp., ° C. | Over aging time, sec |
|---|---|---|---|---|---|---|---|---|
| 1 | C | 900 | 6.0 | 1.0 | 84 | 780 | 240–400 | 140 |
| 2 | C | 870 | 6.0 | 1.6 | 73 | 840 | 320–440 | 25 |
| 3 | C | 870 | 6.0 | 1.6 | 73 | 960 | 320–440 | 40 |
| 4 | D | 890 | 4.5 | 1.4 | 69 | 880 | 320–440 | 25 |
| 5 | D | 890 | 4.5 | 1.2 | 73 | 800 | 320–440 | 20 |
| 6 | D | 890 | 4.5 | 1.2 | 73 | 720 | 320–440 | 25 |

| Sample No. | Type of steel | Grain diameter, μm | Yield point, MPa | Tensile strength, MPa | Elongation, % | Relative permeability | Relative permeability after aging under 200° C. × 2 hr | Example |
|---|---|---|---|---|---|---|---|---|
| 1 | C | 19 | 325 | 455 | 37 | 590 | 590 | Inv. |
| 2 | C | 24 | 317 | 446 | 37 | 640 | 630 | Inv. |
| 3 | C | 9 | 364 | 461 | 35 | 430 | 430 | Comp. |
| 4 | D | 25 | 320 | 457 | 39 | 650 | 640 | Inv. |
| 5 | D | 17 | 335 | 468 | 37 | 570 | 570 | Inv. |
| 6 | D | 4 | 428 | 710 | 6 | 130 | 130 | Comp. |

Note: Underlined values are outside the scope of the invention.

TABLE 4

| | Sample | Average color shift value in quadrants A to D formed by dividing surface of cathode-ray tube in four parts | | | | | | | | | | | |
|---|---|---|---|---|---|---|---|---|---|---|---|---|---|
| | | 21-inch television cathods-ray tube | | | | | | 36-inch television cathode-ray tube | | | | | |
| | No., | Bh, μm | | Bv, μm | | | | Bh, μm | | Bv, μm | | | |
| Example | Table 2 | A | B | A | B | C | D | A | B | A | B | C | D |
| Inv. | 12 (steel G) | 29 | 27 | −40 | −31 | −35 | −57 | 75 | 65 | −49 | −53 | −33 | −65 |
| Comp. | 30 (steel Q) | 29 | 30 | −53 | −45 | −49 | −75 | 76 | 75 | −66 | −73 | −44 | −85 |
| Improvement, % | | 0 | 10 | 25 | 31 | 29 | 24 | 1 | 13 | 26 | 27 | 25 | 24 |

What is claimed is:

1. A high strength cold rolled steel sheet having improved geomagnetic shielding properties, comprising, by weight, carbon: 0.0003 to 0.0060%, silicon: 0.3 to 1.8%, manganese: 0.2 to 1.8%, phosphorus: not more than 0.12%, sulfur: 0.001 to 0.012%, aluminum: less than 0.005%, and nitrogen: not more than 0.0030%, provided that %Mn/%S≧60 wherein %Mn represents the manganese content and %S represents the sulfur content, with the balance consisting of iron and unavoidable impurities, said high strength cold rolled steel sheet having a ferrite grain diameter of 10 to 200 μm in its metallographic structure and a relative permeability of not less than 500 in a d.c. magnetic field of 0.3 Oe.

2. A high strength cold rolled steel sheet having improved geomagnetic shielding properties, comprising, by weight, carbon: 0.0003 to 0.0060%, silicon: 0.3 to 1.8%, manganese: 0.2 to 1.8%, phosphorus: not more than 0.12%, sulfur: 0.001 to 0.012%, aluminum: 0.005 to 0.04%, nitrogen: not more than 0.0030%, and boron: 0.0010 to 0.0030%, provided that %Mn/%S≧60 and %B/%N≧0.5 wherein %Mn represents the manganese content, %S represents the sulfur content, %N represents the nitrogen content, and %B represents the boron content, with the balance consisting of iron and unavoidable impurities, said high strength cold rolled steel sheet having a ferrite grain diameter of 10 to 200 μm in its metallographic structure and a relative permeability of not less than 500 in a d.c. magnetic field of 0.3 Oe.

3. A high strength electroplated steel sheet having improved geomagnetic shielding properties according to claim 1, wherein the relative permeability is not less than 500 in a d.c. magnetic field of 0.3 Oe, said high strength electroplated steel sheet obtainable by electroplating a cold rolled steel sheet with the silicon content of a surface layer being not more than 5%.

4. A high strength plated steel sheet having improved geomagnetic shielding properties according to claim 1, wherein the relative permeability is not less than 500 in a d.c. magnetic field of 0.3 Oe.

5. An explosion-proof band or an outer magnetic shielding material for a television cathode-ray tube using the steel sheet according to claim 1.

6. A process for producing a high strength cold rolled steel sheet having improved geomagnetic shielding properties, comprising the steps of: finish rolling a slab having the chemical composition described in claim 1 at 750 to 980° C.; cold rolling the resultant plate with a reduction ratio of 60 to 90%; and, in a continuous annealing equipment, subjecting the cold rolled plate to annealing in the temperature range of 750° C. to the $Ac_3$ point to produce a high strength cold rolled steel sheet having a ferrite grain diameter of 10 to 200 μm in its metallographic structure and a relative permeability of not less than 500 in a d.c. magnetic field of 0.3 Oe.

7. A process for producing a high strength cold rolled steel sheet having improved geomagnetic shielding properties, comprising the steps of: finish rolling a slab having the chemical composition described in claim 1 at 750 to 980° C.; cold rolling the resultant plate with a reduction ratio of 60 to 90%; and, in a continuous annealing equipment having an over aging zone, subjecting the steel sheet to annealing in the temperature range of 750° C. to the $Ac_3$ point and to over aging at 300 to 450° C. for not less than 120 sec to produce a high strength cold rolled steel sheet having a ferrite grain diameter of 10 to 200 μm in its metallographic structure and a relative permeability of not less than 500 in a d.c. magnetic field of 0.3 Oe.

8. A process for producing a high strength electroplated steel sheet having improved geomagnetic shielding properties, comprising the steps of: finish rolling a slab having the chemical composition described in claim 3 at 750 to 980° C.; coiling the resultant strip at 700° C. or below; cold rolling the coil with a reduction ratio of 60 to 90%; and, in a continuous annealing equipment, subjecting the steel sheet to annealing in the temperature range of 750° C. to the $Ac_3$ point in a dew point of 0° C. or below to produce a cold rolled steel sheet having a ferrite grain diameter of 10 to 200 μm in its metallographic structure and a surface layer silicon content of not more than 5%; and electroplating the cold rolled steel sheet to produce a high strength electroplated steel sheet having a relative permeability of not less than 500 in a d.c. magnetic field of 0.3 Oe.

9. A process for producing a high strength electroplated steel sheet having improved geomagnetic shielding properties, comprising the steps of: finish rolling a slab having the chemical composition described in claim 3 at 750 to 980° C.; coiling the resultant strip at 700° C. or below; cold rolling the coil with a reduction ratio of 60 to 90%; and, in a continuous annealing equipment having an over aging zone, annealing the steel sheet in the temperature range of 750° C. to the $Ac_3$ point in a dew point of 0° C. or below and subsequently subjecting the annealed sheet to over aging at 300 to 450° C. for not less than 120 sec to produce a cold rolled steel sheet having a ferrite grain diameter of 10 to 200 μm in its metallographic structure and a surface layer silicon content of not more than 5%; and electroplating the cold rolled steel sheet to produce a high strength electroplated steel sheet having a relative permeability of not less than 500 in a d.c. magnetic field of 0.3 Oe.

10. A process for producing a high strength plated steel sheet having improved geomagnetic shielding properties, comprising the steps of: finish rolling a slab having the chemical composition described in claim 4 at 750 to 980° C.; cold rolling the resultant plate with a reduction ratio of 60 to 90%; and, in a continuous annealing equipment or in an in-line annealing type continuous galvanizing equipment, annealing the steel sheet in the temperature range of 750° C. to the $Ac_3$ point to produce a high strength plated steel sheet having a ferrite grain diameter of 10 to 200 μm in its metallographic structure and a relative permeability of not less than 500 in a d.c. magnetic field of 0.3 Oe.

11. A process for producing a high strength plated steel sheet having improved geomagnetic shielding properties, comprising the steps of: finish rolling a slab having the chemical composition described in claim 4 at 750 to 980° C.; cold rolling the resultant plate with a reduction ratio of 60 to 90%; and, in a continuous annealing equipment having an over aging zone or in an in-line annealing type continuous galvanizing equipment, subjecting the cold rolled plate to annealing in the temperature range of 750° C. to the $Ac_3$ point and over aging at 300 to 450° C. for not less than 120 sec to produce a high strength plated steel sheet having a ferrite grain diameter of 10 to 200 μm in its metallographic structure and a relative permeability of not less than 500 in a d.c. magnetic field of 0.3 Oe.

12. A high strength electroplated steel sheet having improved geomagnetic shielding properties according to claim 2, wherein the relative permeability is not less than 500 in a d.c. magnetic field of 0.3 Oe, said high strength electroplated steel sheet obtainable by electroplating a cold rolled steel sheet with the silicon content of a surface layer being not more than 5%.

13. A high strength plated steel sheet having improved geomagnetic shielding properties according to claim 2, wherein the relatively permeability is not less than 500 in a d.c. magnetic field of 0.3 Oe.

14. An explosion-proof band or an outer magnetic shielding material for a television cathode ray tube using the steel sheet according to claim 2.

15. A process for producing a high strength cold rolled steel sheet having improved geomagnetic shielding properties, comprising the steps of: finish rolling a slab having the chemical composition described in claim 2 at 750 to 980° C.; cold rolling the resultant plate with a reduction ratio of 60 to 90%; and, in a continuous annealing equipment, subjecting the cold rolled plate to annealing in the temperature range of 750° C. to the $Ac_3$ point to produce a high strength cold rolled steel sheet having a ferrite grain diameter of 10 to 200 μm in its metallographic structure and a relative permeability of not less than 500 in a d.c. magnetic field of 0.3 Oe.

16. A process for producing a high strength cold rolled steel sheet having improved geomagnetic shielding properties, comprising the steps of: finish rolling a slab having the chemical composition described in claim 2 at 750 to 980° C; cold rolling the resultant plate with a reduction ratio of 60 to 90%; and, in a continuous annealing equipment having an over aging zone, subjecting the steel sheet to annealing in the temperature range of 750° C. to the $Ac_3$ point and to over aging at 300 to 450° C. for not less than 120 sec to produce a high strength cold rolled steel sheet having a ferrite grain diameter of 10 to 200 μm in its metallographic structure and a relative permeability of not less than 500 in a d.c. magnetic field of 0.3 Oe.

17. A process for producing a high strength electroplated steel sheet having improved geomagnetic shielding properties, comprising the steps of: finish rolling a slab having the chemical composition described in claim 12 at 750 to 980° C.; coiling the resultant strip at 700° C. or below; cold rolling the coil with a reduction ratio of 60 to 90%; and, in a continuous annealing equipment, subjecting he steel sheet to annealing in the temperature range of 750° C. to the $Ac_3$ point in a dew point of 0° C. or below to produce a cold rolled steel sheet having a ferrite grain diameter of 10 to 200 μm in its metallographic structure and a surface layer silicon content of not more than 5%; and electroplating the cold rolled steel sheet to produce a high strength electroplated steel sheet having a relative permeability of not less than 500 in a d.c. magnetic field of 0.3 Oe.

18. A process for producing a high strength electroplated steel sheet having improved geomagnetic shielding properties, comprising the steps of: finish rolling a slab having the chemical composition described in claim 12 at 750 to 980° C.; coiling the resultant strip at 700° C. or below; cold rolling the coil with a reduction ratio of 60 to 90%; and, in a continuous annealing equipment having an over aging zone, annealing the steel sheet in the temperature range of 750° C. to the $Ac_3$ point in a dew point of 0° C. or below and subsequently subjecting the annealed sheet to over aging at 300 to 450° C. for not less than 120 sec to produce a cold rolled steel sheet having a ferrite grain diameter of 10 to 200 μm in its metallographic structure and a surface layer silicon content of not more than 5%; and electroplating the cold rolled steel sheet to produce a high strength electroplated steel sheet of not less than 500 in a d.c. magnetic field of 0.3 Oe.

19. A process for producing a high strength plated steel sheet having improved geomagnetic shielding properties, comprising the steps of: finish rolling a slab having the chemical composition described in claim 13 at 750 to 980° C.; cold rolling the resultant plate with a reduction ratio of 60 to 90%; and, in a continuous annealing equipment or in an in-line annealing type continuous galvanizing equipment, annealing the steel sheet in the temperature range of 750° C. to the $Ac_3$ point to produce a high strength plated steel sheet having a ferrite grain diameter of 10 to 200 μm in its metallographic structure and a relative permeability of not less than 500 in a d.c. magnetic field of 0.3 Oe.

20. A process for producing a high strength plated steel sheet having improved geomagnetic shielding properties, comprising the steps of: finish rolling a slab having the chemical composition described in claim 13 at 750 to 980° C; cold rolling the resultant plate with a reduction ratio of 60 to 90%; and, in a continuous annealing equipment having an over aging zone or in an in-line annealing type continuous galvanizing equipment, subjecting the cold rolled plate to annealing in the temperature range of 750° C. to the $Ac_3$ point and over aging at 300 to 450° C. for not less than 120 sec to produce a high strength plated steel sheet having a ferrite grain diameter of 10 to 200 μm in its metallographic structure and a relative permeability of not less than 500 in a d.c. magnetic field of 0.3 Oe.

* * * * *